US006082446A

United States Patent [19]

Ahaus et al.

[11] Patent Number: 6,082,446

[45] Date of Patent: Jul. 4, 2000

[54] SEALING METHOD AND APPARATUS FOR A HEAT EXCHANGER

[75] Inventors: Fredric A. Ahaus; William S. Ninde, both of Richmond, Ind.

[73] Assignee: Ahaus Tool and Engineering, Inc., Richmond, Ind.

[21] Appl. No.: 09/063,286

[22] Filed: Apr. 20, 1998

[51] Int. Cl.[7] ..... F28F 9/02

[52] U.S. Cl. ..... 165/173; 165/149; 165/175

[58] Field of Search ..... 165/173, 153, 165/149, 174, 152

[56] References Cited

U.S. PATENT DOCUMENTS

| | | | |
|---|---|---|---|
| 4,289,507 | 9/1981 | Cadars et al. | 55/195 |
| 4,546,822 | 10/1985 | Tamura | 165/149 |
| 4,546,823 | 10/1985 | Melnyk | 165/149 |
| 4,649,628 | 3/1987 | Allemandou | 165/148 |
| 4,940,086 | 7/1990 | Stay | 165/173 |
| 4,971,145 | 11/1990 | Lyon | 165/173 |
| 5,107,924 | 4/1992 | Herbert et al. | 165/173 |
| 5,178,211 | 1/1993 | Bauer et al. | 165/153 |
| 5,195,582 | 3/1993 | Haase | 165/173 |
| 5,201,368 | 4/1993 | Kroetsch | 165/173 |
| 5,214,848 | 6/1993 | Lelievre | 29/890.053 |
| 5,238,059 | 8/1993 | Smith | 165/173 |
| 5,246,065 | 9/1993 | Huff | 165/173 |
| 5,351,751 | 10/1994 | Cage et al. | 165/173 |
| 5,535,821 | 7/1996 | Potier | 165/173 |
| 5,590,710 | 1/1997 | Sasaki et al. | 165/173 |

*Primary Examiner*—Ira S. Lazarus
*Assistant Examiner*—Terrell McKinnon
*Attorney, Agent, or Firm*—Woodard, Emhardt, Naughton, Moriarty & McNett, Patent and Trademark Attorneys

[57] ABSTRACT

A heat exchanger for a vehicle. The heat exchanger includes a tank which has a peripheral foot that is in contact with a seal within a channel of a header. The header is coupled to the tank by a plurality of bendable tabs on the header that are bent onto an upper surface of the peripheral foot. A compression stop located on the external surface of the tank prevents distortion and excessive compression of the seal during the bending operation.

29 Claims, 5 Drawing Sheets

SEALING METHOD AND APPARATUS FOR A HEAT EXCHANGER

BACKGROUND OF THE INVENTION

The present invention relates to a seal for a heat exchanger, especially for heat exchangers useful in vehicles.

Almost all vehicles such as automobiles, trucks, and busses include heat exchangers for rejecting waste heat back into the ambient surroundings. This waste heat may come directly from the vehicle engine, air conditioning system, transmission, or other heat rejecting systems. In order to manufacture these heat exchangers at a low cost, it is necessary to employ fabrication and assembly techniques that are amenable to a high production rate.

Some vehicle heat exchangers are produced by coupling a lightweight, molded plastic tank to a brazed aluminum header assembly. In some of those heat exchangers an elastomeric o-ring or seal is placed between the tank and header assembly. A force is applied to the tank and header so as to compress the o-ring and while the header and tank are so forced together, tabs on the header are bent against the tank to couple the header and tank together.

Often during the operation of bending the tabs the loads required to bend the tab also distort the channel or groove within which the o-ring has been placed. The operation of bending the tabs thus compresses the o-ring beyond the level of compression achieved prior to the bending operation. The o-ring may be compressed beyond recognized compression limits. Although this over compression may result in an acceptable seal immediately after manufacturing, repeated thermal cycling of the radiator will eventually cause the overcompressed o-ring to crack and leak. In addition, the overcompressed o-ring may experience excessive compression set, such that the o-ring may retract from the adjacent sealing surfaces and cease to seal under cold ambient conditions.

The present invention provides a novel and unobvious method and apparatus for limiting compression of the heat exchanger seal.

SUMMARY OF THE INVENTION

The present invention provides an apparatus which comprises a heat exchanger, the heat exchanger including a first member, a seal, and a second member. The first member includes a channel and defines a plurality of notches. The seal is within the channel. The second member includes an external surface and a plurality of compression stops along the external surface. The second member also includes a sealing surface for compressing the seal. The sealing surface compresses the seal within the channel with at least one of the compression stops being aligned within one of the notches to limit the compression of the seal.

It is an object of the present invention to provide an improved heat exchanger.

These and other objects of the present invention will be apparent from the description of the drawings, description of the preferred embodiment, and the claims to follow.

DESCRIPTION OF THE PREFERRED EMBODIMENT

Figure 1:
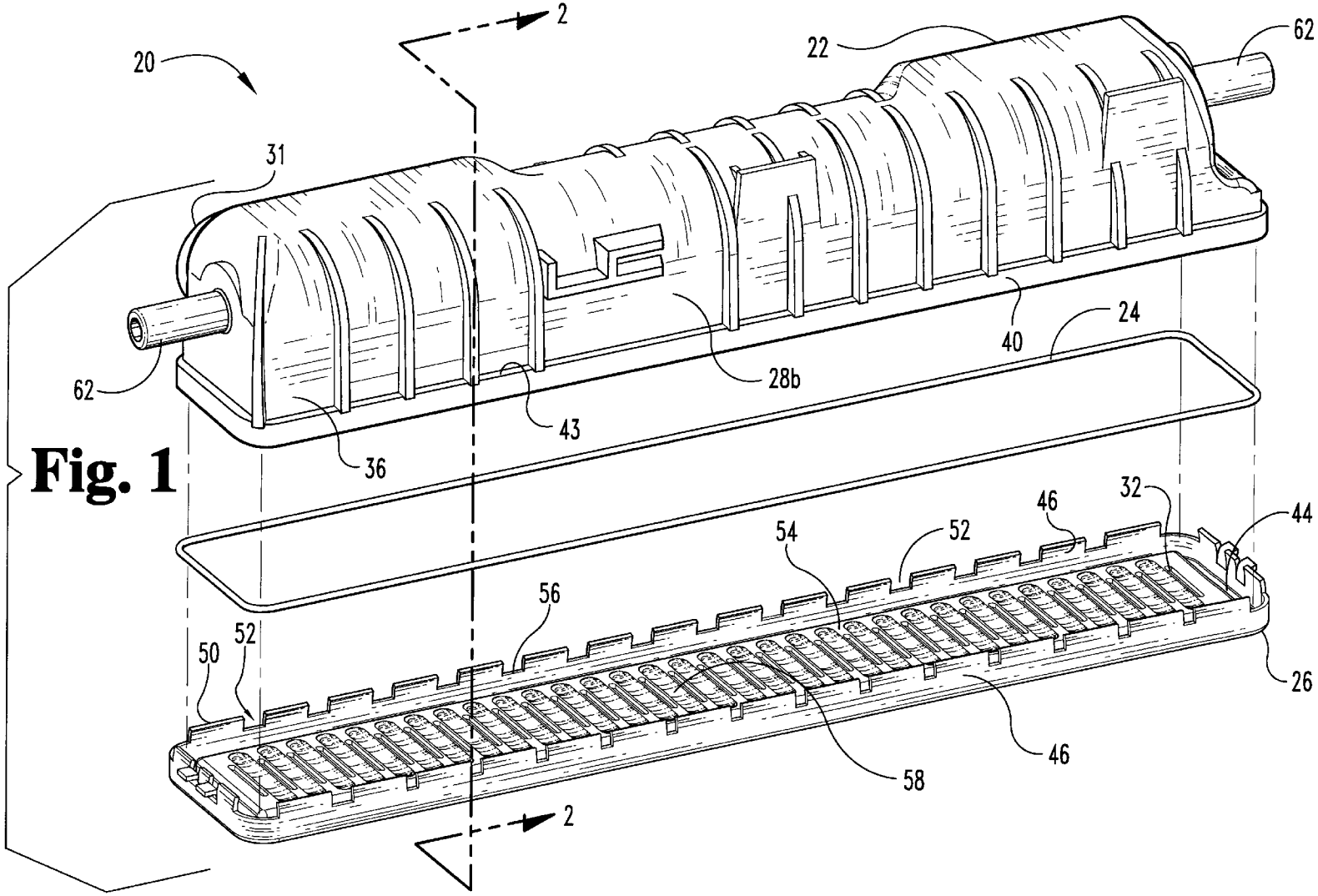
FIG. 1 is an exploded perspective view of an apparatus useful with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 is an exploded view of an apparatus useful with the present invention. Exploded apparatus 20 is part of a heat exchanger for a vehicle such as a car, truck, bus, or other vehicle that requires a heat exchanger. Apparatus 20 includes a first member or a tank 22, a seal 24, and a second member or header 26. First member 22 includes a pair of opposing walls 28*a* and 28*b*. Assembly of first member 22 onto second member 26 results in formation of a flow channel 30 (see FIG. 4). A cooling medium to be cooled flows into or out of flow channel 30 through a plurality of tubes (not shown) that provide the cooling medium through a plurality of slots 32 formed within header 26. First member 22 may also include one or more ports 31 in fluid communication with flow channel 30 for providing the cooling medium into or out of flow channel 30. Some embodiments also include supports 62 useful for supporting apparatus 20 within vibration isolators. Those of ordinary skill in the art will recognize apparatus 20 as being useful with an engine cooling radiator of an automobile. However, the present invention is useful with a variety of heat exchangers, including by way of example only heat exchangers for transmission fluid, oil, and substances useful in air conditioners.

Tank 22 includes a plurality of ribs 34 spaced apart along external surface 36 of opposing walls 28*a* and 28*b*. Ribs 34 stiffen opposing walls 28*a* and 28*b* so as to resist the pressure within flow channel 30 with relatively thin opposing walls 28*a* and 28*b*. However, those of ordinary skill in the art will recognize that by thickening walls 28*a* and 28*b*, or substituting a high strength material for the manufacture of tank 22, it is not necessary to have ribs 34. Tank 22 is typically made from a heat resistant structural plastic.

Figure 2:
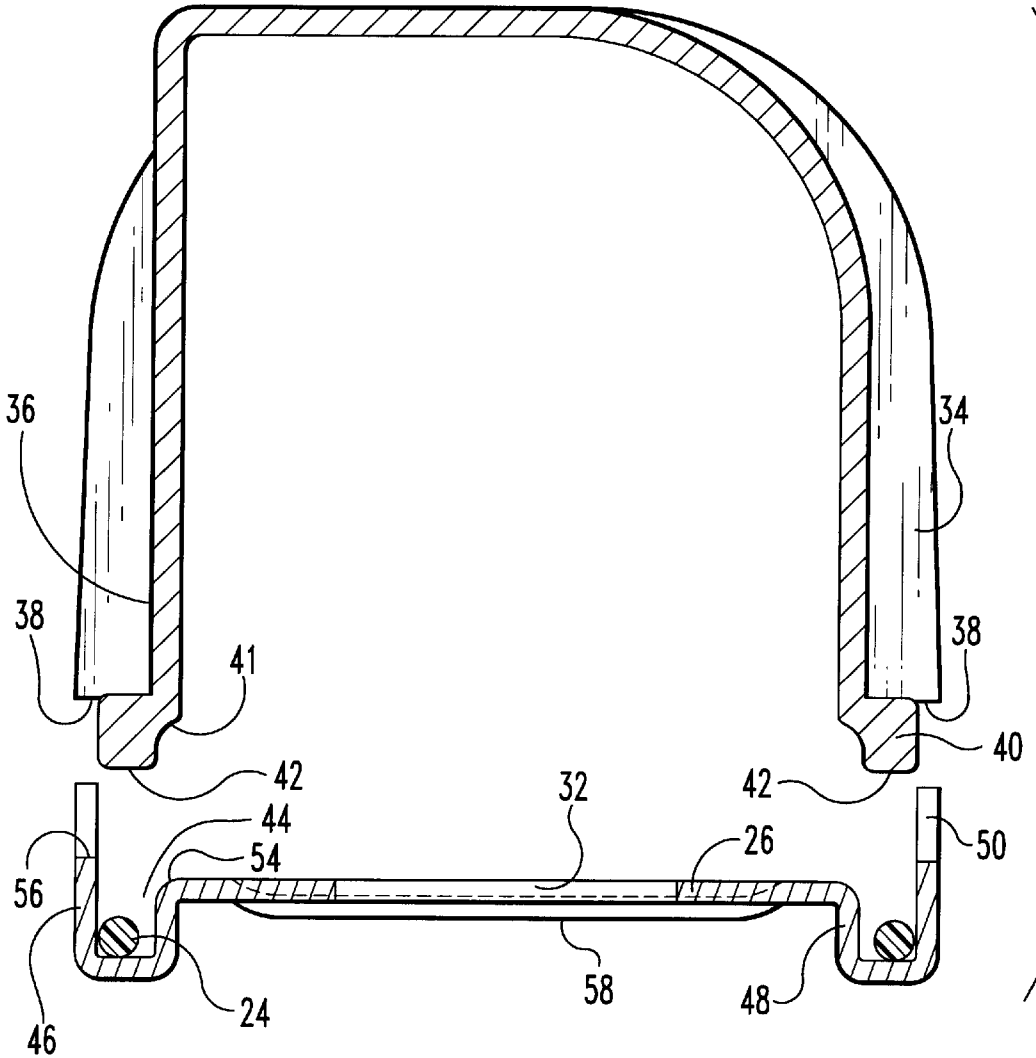
FIG. 2 is a cross-sectional view of the apparatus of FIG. 1 as taken along plane 2—2.

First member 22 also includes a foot 40 that extends around the periphery of the opened end of tank 22 (see FIG. 2). Foot 40 includes a bottom surface 42 that is useful for sealing against seal 24. Foot 40 includes an inner surface or heel section 41 along the inner side of foot 40. Ribs 34 come in contact with the upper external surface of foot 40. Ribs 34 also includes a compression stop 38 that projects outwardly from foot 40.

Second member 26 includes a pair of generally opposing walls, outer wall 46 and inner wall 48. Walls 46 and 48 are boundaries of a groove or channel 44 that generally extends around the periphery of header 26. Channel 44 is shaped to accept within it foot 40 of tank 22. A plurality of bendable tabs 50 project upward from outer wall 46 and extend generally around the periphery of header 26. Notches 52 are preferably provided between adjacent tabs 50. The present invention also envisions those embodiments in which latches 52 are not between adjacent tabs 50. Second member 26 is preferably fabricated from a brazeable material, such as by way of example only, aluminum.

Seal 24 is placed within groove 44 prior to coupling of tank 22 to header 26. Seal 24 is preferably an elastomeric o-ring which may be fabricated from a variety of materials, such as by way of example only, fluorocarbon, fluorosilicon, silicon, butyl, or other elastomers. Although seal 24 is depicted with a generally circular cross-section in the free state, those of ordinary skill in the art will recognize that seals of other cross-sections are useful with the present invention, including by way of example only, "C" cross-sectional shapes and others. Seal 24 may also be a settable material applied within channel 44, or other types of seals known to those of ordinary skill in the art.

Located at the bottom of notch 52 is outer reaction surface 56 of wall 46. Although notches 52 are depicted with a generally rectangular shape, those of ordinary skill in the art will recognize that other shapes, including by way of example only, a circular, oval, or triangular shape, is also useful with the present invention. An inner reaction surface 54 is located along the top of inner wall 48. Inner reaction surface 54 is shaped so as to be generally complementary to inner surface 41 of foot 40. Header 26 also includes a plurality of dimples 58 provided between adjacent slots 32. Those of ordinary skill in the art will recognize that although it is preferable to include dimples 58 within the structure of header 26, dimples 58 are not necessary for the present invention.

Figure 3:
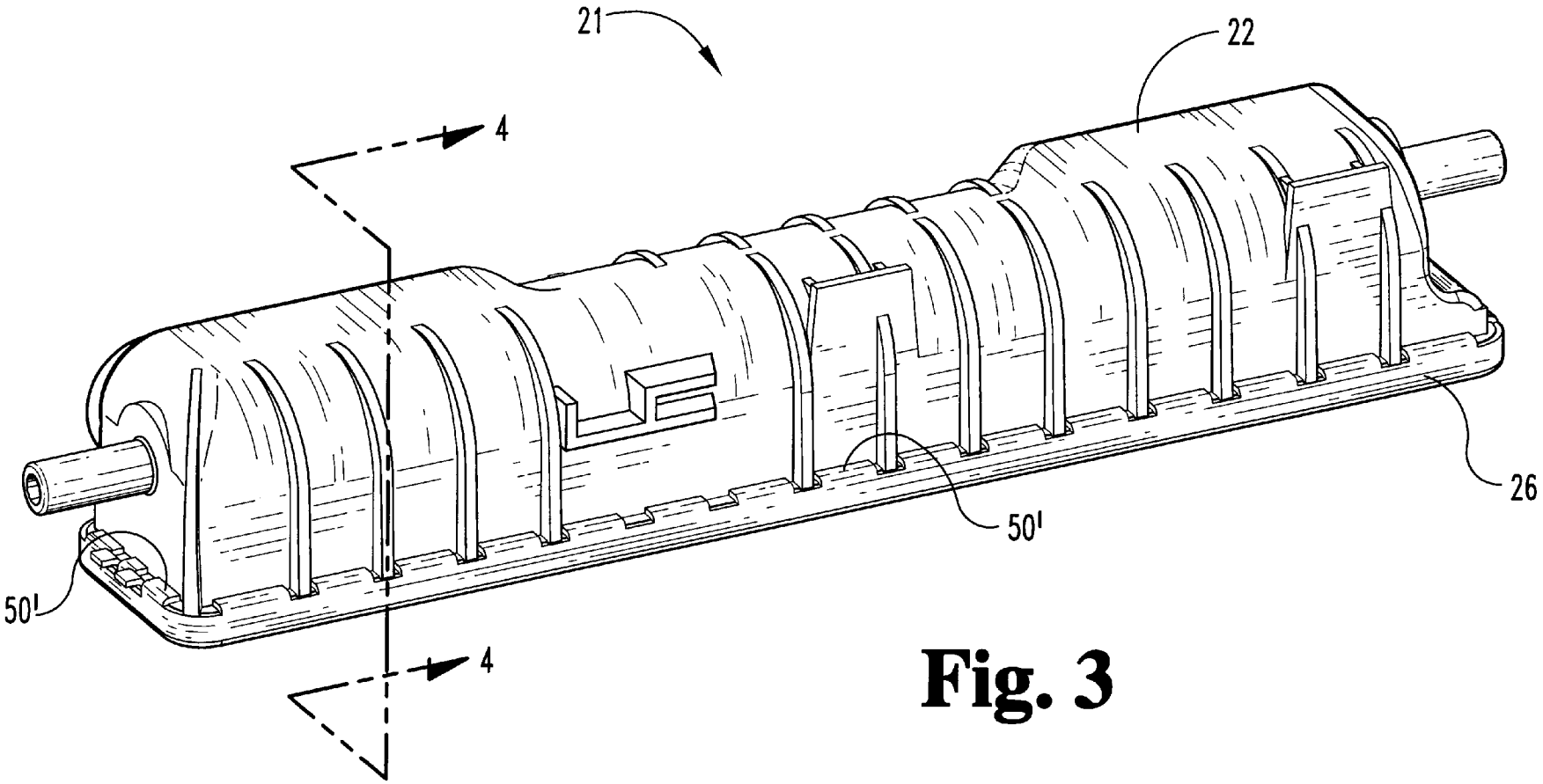
FIG. 3 is a perspective view of the apparatus of FIG. 1 after assembly.

Exploded apparatus 20 is shown assembled as apparatus 21 in FIG. 3. Assembly of a heat exchanger with the present invention typically includes first preparing a header assembly (not shown) which includes a header 26 attached to a plurality of tubes (not shown) located within slots 32. The other end of the tubes may be attached to another header. The assembly of headers and tubes is typically brazed together. Seal 24 is placed within groove 44 of header 26. First member 22 is then brought into contact with the assembly of header 26 and seal 24. A portion of foot 40 fits within channel 44, with bottom sealing surface 42 coming into contact with seal 24. Compression stops 38 are aligned within notches 52.

In the preferred embodiment, seal 24 has a cross-sectional size large enough that compression stop 38 of tank 22 does not come into contact with outer reaction surface 56 of header 26 unless a force 60 is applied to tank 22. Although force 60 is shown as a point load applied to the top surface of tank 22, those of ordinary skill in the art will recognize other ways of applying a force 60 that compresses seal 24, including a force 60 distributed over the length or width of tank 22, or a force 60 applied to upper surface 43 of foot 40, by way of example only. Force 60 may be applied in a variety of ways known to those of ordinary skill in the art, including by way of example only having a loading mechanism come into contact with tank 22 or applying a partial vacuum within flow channel 30. As force 60 is applied to tank 22, sealing surface 42 of foot 40 compresses seal 24 within channel 44.

In one embodiment of the present invention force 60 is increased until inner surface 41 of foot 40 contacts inner reaction surface 54 of header 26. A portion of the force applied to tank 22 is reacted at inner reaction surface 54 of header 26. Foot 40 and header 26 are sized such that seal 24 is compressed less than about 40% and more than about 20% when heel 41 contacts surface 54. This degree of compression has been found to provide a reliable, leakproof seal over an extended period of time and many heating and cooling cycles of the heat exchanger.

Figure 4:
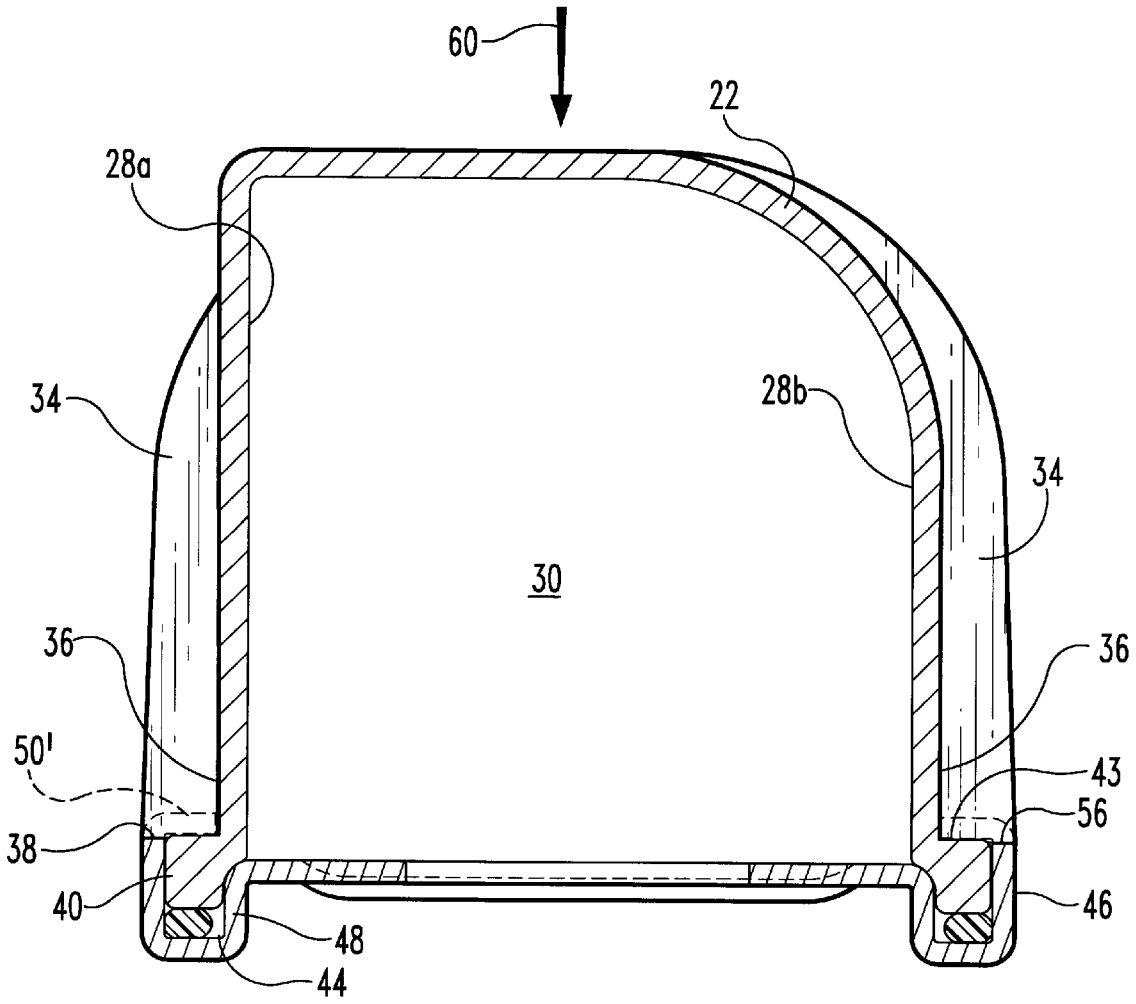
FIG. 4 is a cross-sectional view of the apparatus of FIG. 3 as taken along plane 4—4 of FIG. 3.

With force 60 maintained on tank 22, tabs 50 are preferably bent against upper surface 43 of foot 40. As tabs 50 are being bent, compression stop 38 comes into contact with outer reaction surface 56 of outer wall 46. This contacting of surface 56 with compression stop 38 limits bending and distortion of channel 44 as tabs 50 are bent. By limiting distortion and bending of channel 44 the amount of compression of seal 24 can be maintained between the desirable limits of about more than 20% and about less than 40%. The contacting of surface 56 with compression stop 38 prevents upward movement of outer wall 46 in the vicinity of stop 38 during the bending process. FIG. 4 shows a cross-sectional view of the assembled apparatus 21 with tabs 50 bent to position 50' so as to couple tank 22 to header 26. Although a plurality of bendable tabs have been shown and described for coupling the header to the tank, the present invention also contemplates other means of coupling the header to the tank, such as by way of example only the use of one or more fasteners to couple the header to the tank.

Although the present invention has been described as being useful with maintaining compression on seal ring 24 of more than about 20% and less than about 40%, those of ordinary skill in the art will recognize that these limits are useful for many of the elastomeric compounds previously described. The present invention is useful for maintaining other ranges of compression as could be required with different materials. The present invention is useful for providing other ranges of seal compression by altering the distance from sealing surface 42 to inner surface 41, and/or the distance from sealing surface 42 to compression stop 38. Alternatively, the depth of channel 44 may also be altered to provide a different range of seal compression. The present invention provides an assembled apparatus 21 with a Cpk parameter relating to statistical process control (SPC) of about 1.67.

In another embodiment of the present invention, force 60 is increased until compression stop 38 contacts reaction surface 56. Force 60 is maintained at a level sufficient to provide contact between stop 38 and surface 56, and tabs 50 are thereupon bent over into contact with upper surface 43. Thus, it is not necessary in the present invention that heel 41 be in contact with inner reaction surface 54. Outer reaction surface 56 of outer wall 46 of channel 44 is useful for reacting a portion of force 60 transmitted by compression stop 38.

In yet another embodiment of the present invention, force 60 is increased until some or all of stops 38 are in contact with reaction surface 56, and some or all of inner surface 41 are in contact with inner reaction surface 54.

Figure 5:
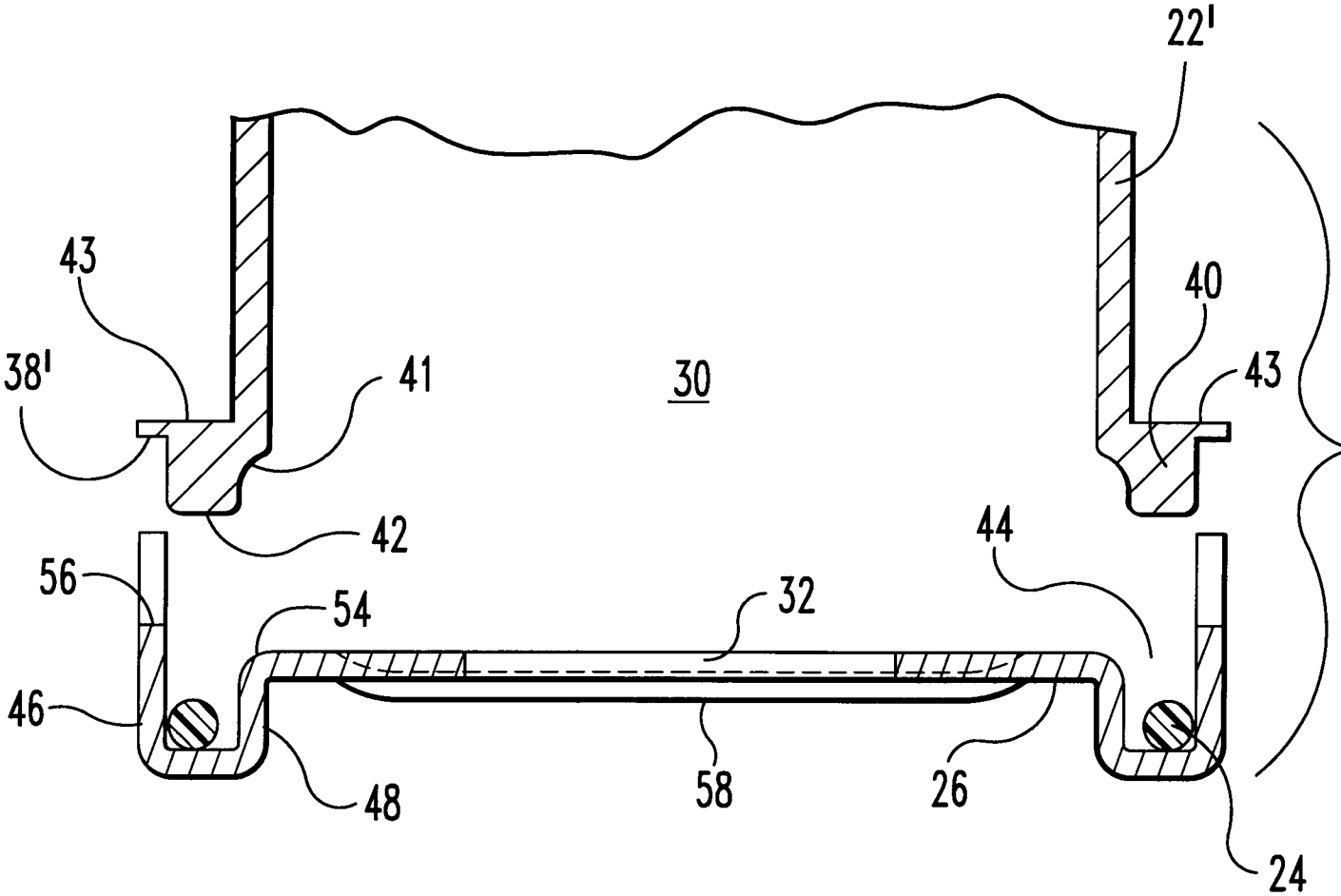
FIG. 5 is a cross-sectional view similar to FIG. 2 of an alternate embodiment of the present invention.

FIG. 5 shows an alternate embodiment of the present invention. A compression stop 38' projects outwardly from upper surface 43 of foot 40. During assembly of tank 22' onto header 26, compression stop 38' contacts reaction surface 56 in a manner as previously described. Although compression stops 38 and 38' have been shown and described as being located near foot 40, compression stop 38 and 38' and upper reaction surface 56 provide a means for limiting compression of the seal and may be located at different locations. For example, means for limiting compression of the seal could be located at other locations along opposing walls 28*a* and 28*b*. The present invention contemplates an outer reaction surface 56 of the outer wall of the channel of the header that extends above the upper surface of the foot and contacts a compression stop located along the opposing walls of the tank. In yet another embodiment, the means for limiting compression of the seal could be located between the upper surface and bottom surface of the foot, such that the compression stop extends midway between the upper surface and bottom surface of the foot. In another embodiment, the compression stop is placed between adjacent ribs. For headers and tanks made from the types of materials previously described, it is preferable that compression stops be spaced apart more than about three eighths of an inch and less than about three fourths of an inch. Those of ordinary skill in the art will recognize that the spacing may change as the material of the header or tank changes, or as the wall thickness of the header or tank changes.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A heat exchanger for a vehicle which comprises:

a header defining a channel with an outer wall, said header including a plurality of tabs along the outer wall;

a seal within the channel; and a tank with an external surface, said tank including a plurality of compression stops along the external surface, said tank including a bottom surface for compressing said seal;

wherein the bottom surface compresses said seal and at least one of said compression stops contacts the outer wall between two of said tabs.

2. The invention of claim 1 wherein the channel includes an inner wall and said tank includes an inner surface, wherein a portion of the inner wall contacts the inner surface and limits the compression of said seal.

3. The invention of claim 1 wherein said seal is made from an elastomeric material.

4. The invention of claim 1 wherein said compression stop limits the compression of said seal to more than about twenty percent and less than about forty percent.

5. The invention of claim 1 wherein said tank includes a pair of opposing walls and said plurality of compression stops are spaced apart along said opposing walls.

6. The invention of claim 5 wherein said compression stops are spaced apart more than about three eighths of an inch and less than about three fourths of an inch.

7. The invention of claim 5 wherein one opposing wall includes at least six said compression stops, and the other opposing wall includes at least eight said compression stops.

8. The invention of claim 1 wherein said tabs are bendable to couple said tank to said header.

9. An apparatus which comprises:

a heat exchanger, said heat exchanger including a first member, a seal, and a second member, said first member including a groove, said first member defining a plurality of notches, said seal being within the groove, said second member having an external surface and a plurality of compression stops along the external surface, and said second member including a sealing surface for compressing said seal, wherein the sealing surface compresses said seal and at least one of said compression stops is aligned within one of said notches and limits the compression of said seal.

10. The apparatus of claim 9 wherein a plurality of compression stops are aligned within a plurality of notches.

11. The apparatus of claim 9 wherein said first member is a header.

12. The apparatus of claim 11 wherein said second member is a tank.

13. The apparatus of claim 12 wherein said tank includes a pair of opposing walls and said plurality of compression stops are spaced apart along said opposing walls.

14. The apparatus of claim 13 wherein said compression stops are spaced apart more than about three eighths of an inch and less than about three fourths of an inch.

15. The invention of claim 13 wherein one opposing wall includes at least six said compression stops, and the other opposing wall includes at least eight said compression stops.

16. The apparatus of claim 9 wherein said compression stop limits the compression of said seal to more than about twenty percent and less than about forty percent.

17. A method for assembling a heat exchanger for a vehicle which comprises:

providing a header with a channel having an outer wall;

providing a tank with a sealing foot;

placing a seal in the channel;

applying a force to push the sealing foot into the channel;

compressing the seal; and reacting a portion of the force against the outer wall of the channel.

18. The invention of claim 17 which further comprises reacting a portion of the force against the inner wall of the channel.

19. The invention of claim 17 wherein said compressing is more than about twenty percent and less than about forty percent.

20. The invention of claim 17 which further comprises bending tabs on the header to couple the header to the tank.

21. A heat exchanger for a vehicle which comprises:

a header defining a channel, the channel having an outer wall;

a seal within the channel;

a tank with a bottom surface for compressing said seal; and means for limiting compression of said seal within the channel, said compression limiting means being operable along the outer wall.

22. The invention of claim 21 wherein said header includes an inner wall and said compression limiting means is operable along the inner wall.

23. The invention of claim 21 wherein said seal is made from an elastomeric material.

24. The invention of claim 23 wherein said compression limiting means limits the compression of said seal to more than about twenty percent and less than about forty percent.

25. A method for assembling a heat exchanger for a vehicle which comprises:

providing a first member having a foot with a sealing surface, the first member having a plurality of compression stops;

providing a second member with a groove, the groove having an outer wall with a plurality of bendable tabs;

placing a seal in the groove;

placing the sealing surface into the groove; and bending the tabs around the foot whereby at least a portion of the compression stops come into contact with at least a portion of the outer wall between the tabs.

26. The invention of claim 25 which further comprises after said placing the sealing surface applying a force to compress the seal in the groove.

27. The invention of claim 26 wherein the second member includes an inner reaction surface, and which further comprises reacting at least a portion of the force against the inner wall of the groove.

28. An apparatus comprising:

a header for a heat exchanger, said header defining a channel with an outer wall, said header including a plurality of tabs along the outer wall; an o-ring within the channel; and a tank for a heat exchanger, said tank having an external surface and at least twelve ribs spaced apart along the external surface, each said rib incorporating a compression stop, said tank including a bottom surface for compressing said seal, said header and said tank defining a flow channel therebewteen for passage of a cooling medium;

wherein the bottom surface compresses said o-ring and each said compression stop contacts the outer wall between two of said tabs.

29. The invention of claim 27, wherein the first member is a tank for a vehicle heat exchanger and the second member is a header for a vehicle heat exchanger.

* * * * *